US006967291B2

(12) United States Patent
Rodriguez Navarrete et al.

(10) Patent No.: US 6,967,291 B2
(45) Date of Patent: Nov. 22, 2005

(54) DOUBLE-PASS PUSHBUTTON

(75) Inventors: Luis Rodriguez Navarrete, San Sebastian (ES); Domingo Revilla Asensio, San Sebastian (ES)

(73) Assignee: Angel Iglesias, S.A. (ES)

( * ) Notice: Subject to any disclaimer, the term of this patent is extended or adjusted under 35 U.S.C. 154(b) by 289 days.

(21) Appl. No.: 10/175,124

(22) Filed: Jun. 19, 2002

(65) Prior Publication Data

US 2003/0116411 A1 Jun. 26, 2003

(30) Foreign Application Priority Data

Dec. 21, 2001 (ES) ..... 200102859

(51) Int. Cl.[7] ..... H01H 9/00
(52) U.S. Cl. ..... 200/1 B; 200/302.2
(58) Field of Search ..... 200/5 R, 1 B, 200/5 A, 5 E, 520, 302.2, 329–330, 341, 345, 573, 5 EA, 5 EB, 50.32–50.37, DIG. 29, 500–553

(56) References Cited

U.S. PATENT DOCUMENTS

| | | | | | |
|---|---|---|---|---|---|
| 4,766,272 | A | * | 8/1988 | Guzzon | 200/302.2 |
| 4,877,930 | A | * | 10/1989 | Fukuma | 200/302.2 |
| 4,897,516 | A | * | 1/1990 | Wakatsuki | 200/302.2 |
| 5,152,540 | A | * | 10/1992 | Kuze | 277/634 |
| 5,164,561 | A | * | 11/1992 | Schaeffeler et al. | 200/302.2 |
| 5,272,383 | A | * | 12/1993 | Umemura et al. | 307/112 |
| 5,369,237 | A | * | 11/1994 | Mejerl et al. | 200/524 |
| 5,576,525 | A | * | 11/1996 | Umemura | 200/539 |
| 5,907,138 | A | * | 5/1999 | Metzler | 200/1 B |
| 5,932,854 | A | * | 8/1999 | Umemura | 200/5 B |
| 5,965,854 | A | * | 10/1999 | Umemura | 200/5 E |
| 5,990,431 | A | * | 11/1999 | Wright | 200/302.3 |
| 5,994,652 | A | * | 11/1999 | Umemura | 200/5 B |
| 6,111,331 | A | * | 8/2000 | Fisher et al. | 310/68 A |
| 6,333,476 | B1 | * | 12/2001 | Umemura | 200/318.1 |
| 6,437,270 | B1 | * | 8/2002 | Morrison et al. | 200/520 |

FOREIGN PATENT DOCUMENTS

| | | | |
|---|---|---|---|
| DE | 3207725 | * | 9/1983 |
| EP | 064615 | * | 4/1982 |
| JP | 1225024 | * | 9/1989 |

* cited by examiner

*Primary Examiner*—Elvin Enad
*Assistant Examiner*—Lisa Klaus
(74) *Attorney, Agent, or Firm*—Muserlian, Lucas and Mercanti

(57) ABSTRACT

Double-pass pushbutton, able to act successively on one or both independent microswitches ($M_1$), ($M_2$), where the body shell and the pushbutton have a leaktight and flexible cap mounted between them, which hermetically seals the joint without interfering with the guided axial movement of the pushbutton, with respect to the body to be activated, or stopping the operator's action; it has two contact stops at different heights, for their successive contact with the relative rnicroswitches when moved linearly; and there are means between the body shell and the pushbutton for the successive positioning of the pushbutton. The pushbutton is especially useful in control pushbutton panels.

9 Claims, 2 Drawing Sheets

DOUBLE-PASS PUSHBUTTON

BACKGROUND OF THE INVENTION

1. Field of Invention

This invention deals with a double-pass pushbutton that brings about two successive and differentiated operations, starting from a stand-by position.

A preferential application of the pushbutton targeted by the invention is, for example, on pushbutton panels that send orders by radio or by cable to cranes, industrial public works machinery, or similar.

An important binomial that must be solved in devices of this type is to combine the high sensitivity of the contactors with the aggressive environment where they operate.

2. Description of Related Art

Pushbuttons to manipulate cranes and/or similar public works machinery are already known. The actual applicant is the owner of procedures, both referring to the forms (Industrial Models I125598, I145274, 145275, I151891) and to technology (Patents P492185, P8600454 and Utility Models U280755 and U9102483) of pushbutton panels with pushbuttons that automatically return to their original position when the operator stops applying them.

SUMMARY OF THE INVENTION

One aim of the pushbutton targeted by the invention is to maintain its operating sensitivity without this being affected by rough treatment; that is, maintaining a great rigidity of the shell and outside controls and great smoothness of the inner contactors.

Another objective of the pushbutton targeted by the invention is for its operative positions to be easily detectable by the operator (even in aggressive or unfavourable environments).

An additional objective of the pushbutton targeted by the invention is to achieve this functionality with maximum constructive simplification.

The double-pass pushbutton is able to act successively upon one or both independent microswitches and is characterised because:

a) the body-shell and the pushbutton of the pushbutton have a leaktight and flexible cap mounted between them, which hermetically seals the union without interfering with the guided axial movement of the pushbutton with respect to the body to be activated, or stopping the operator's action;

b) it has two contact stops at different heights, for their successive contact with the relative microswitches when they move linearly;

c) between the body-shell and the pushbutton there are means for the successive positioning of the pushbutton.

It is also characterised because the assembly of the cap in the body-shell and in the pushbutton takes place due to the elastic deformation of the former, which clamps or is housed in combined conformations of the latter.

It is also characterised because the aforementioned operating means are comprised of:

a) in the body-shell, some diametrically formed generatricial ramps;

b) in the pushbutton, a diametrical box where the balls are housed and which are kept in counterposition by an internal spring, which, housed in the box, is aimed at keeping the balls housed in one or other of the generatricial ramps.

It is also characterised because the pushbutton is aimed at being maintained in an end standby position due to the action of one or several pressure springs mounted coaxially to one or both contact stops.

It is also characterised because these generatricial ramps are formed in an independent bushing, mounted on the body-shell with respect to which it stands out on the inside defining a tuck, which some perimeter projections come up against, defined together in the pushbutton, to prevent involuntary disassembly.

BRIEF DESCRIPTION OF THE DRAWINGS

For a better understanding of the object of this invention, a preferential way of practical execution is illustrated on the drawings, subject to accessory changes that take nothing away from its fundamentals.

DETAILED DESCRIPTION OF THE INVENTION

Figures 1, 2, 3, 4:
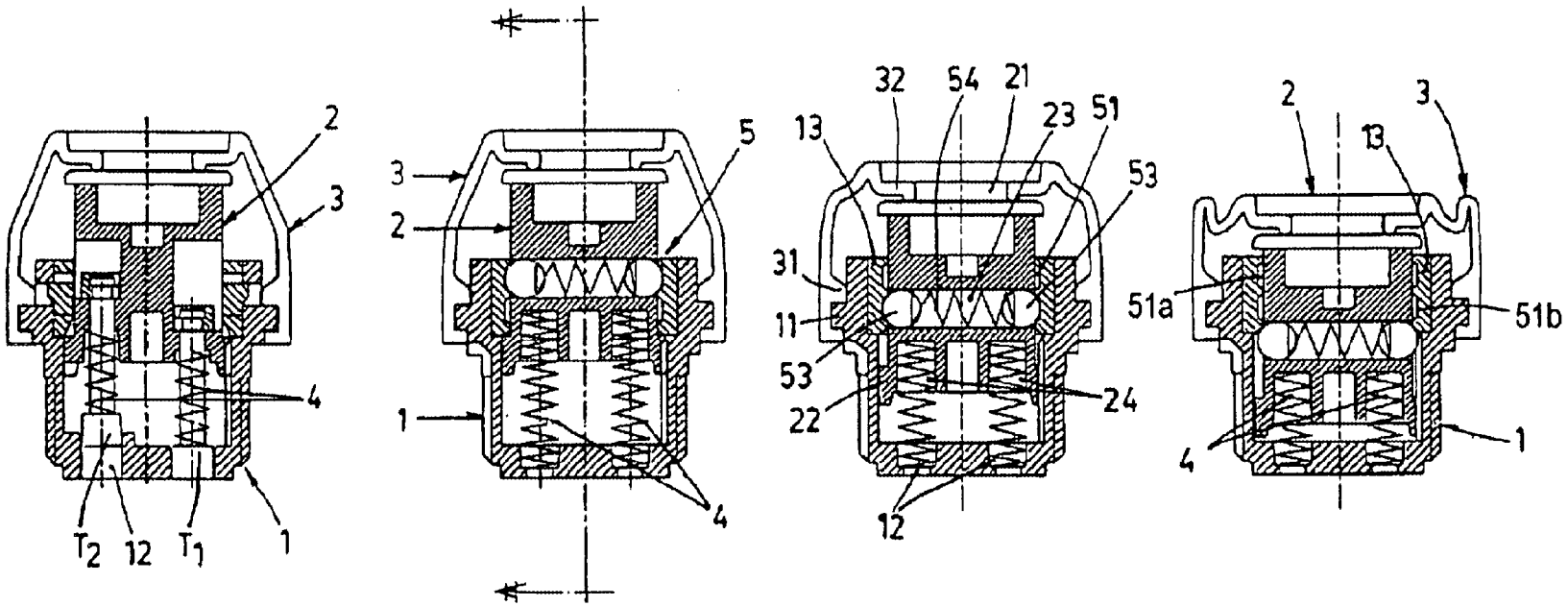
FIGS. 1 to 3 illustrated general elevation sections of the double-pass pushbutton according to the invention, respectively in standby position—FIG. 1—; first operation—FIG. 2—and second operation—FIG. 3—.
FIG. 4 illustrates a profile general section corresponding to FIG. 1.

Below an example of a non-limiting practical execution of this invention is described.

The aim of this invention is a double-pass pushbutton, which is basically comprised of the following elements:

1. —Body-shell.
2. —Pushbutton.
3. —Cap.
4. —Pressure springs.
5. —Operating means.

$M_1$, $M_2$.—Microswitches $T_1$, $T_2$.—Contact stops.

B.—Button-panel.

In accordance with the invention, and according to the execution illustrated, the body-shell (1) includes:

formations (11), above all a perimeter projection, in which combined formations (31) are clamped in order for the cap (3), which is elastic and flexible, to be hermetically mounted.

formations (12), above all axial openings on the base, where the contact stops ($T_1$), ($T_2$) are guided. These formations (12) are formed too, thanks to their different diameters, in positioning seatings of the pressure springs (4), which, in operative position, are aimed at maintaining the pushbutton (2) in a standby position;

a bushing (13), which prevents the involuntary extraction of the pushbutton (2) and defines some ramps, upper box (51*a*) and lower box (51*b*), in its internal perimeter, which form part of the aforementioned opening means (5).

Figure 5:
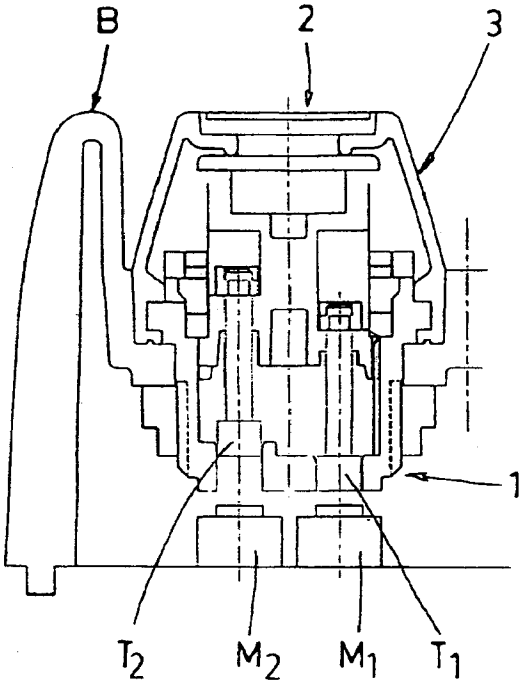

In accordance with the invention, and according to the execution illustrated, the pushbutton (2) includes:

formations (21), above all a perimeter groove where combined formations (32) are housed for the hermetic assembly of the cap (3), which is elastic and flexible;

formations (22), above all perimeter projection(s), which, acting together with the aforementioned bushing (13), prevent the involuntary disassembly of the pushbutton (2) with respect to the body-shell (1);

formations (23), above all a diametrical opening-box where several balls (53) are housed and maintained in counterposition due to the action of an internal spring (54). These balls (53) and internal spring (54) are elements components that form part of the aforementioned operating means (5);

formations (24), above all boxes that are axially opposing axial openings (12) of the body-base (1) which form conflicting stops for the pressure springs (4) and the boxes/housings for the contact stops ($T_1$), ($T_2$), around which these pressure springs are arranged (4). The contact stops ($T_1$), ($T_2$) are placed at different heights—see FIG. 5—.

Figure 7:
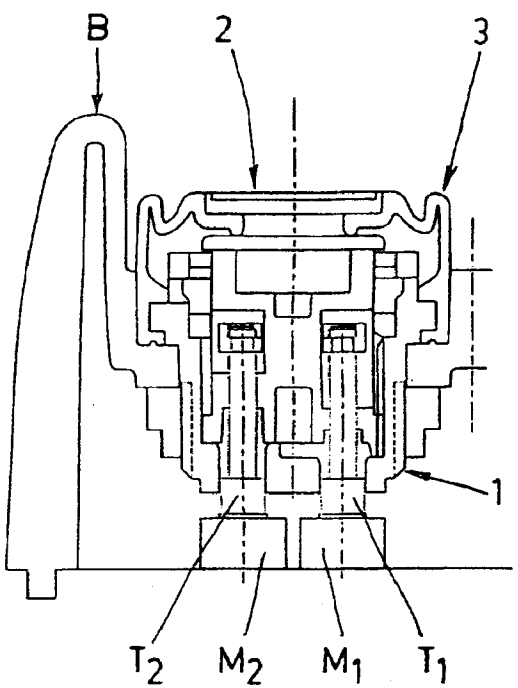
FIGS. 5 to 7 illustrate schematic views similar to FIGS. 1 to 3, and corresponding to them, where one can observe the microswitches ($M_1$), ($M_2$); the contact stops ($T_1$), ($T_2$); and the pushbutton according to the invention integrated in the shell of a pushbutton panel (B).
Figure 6:
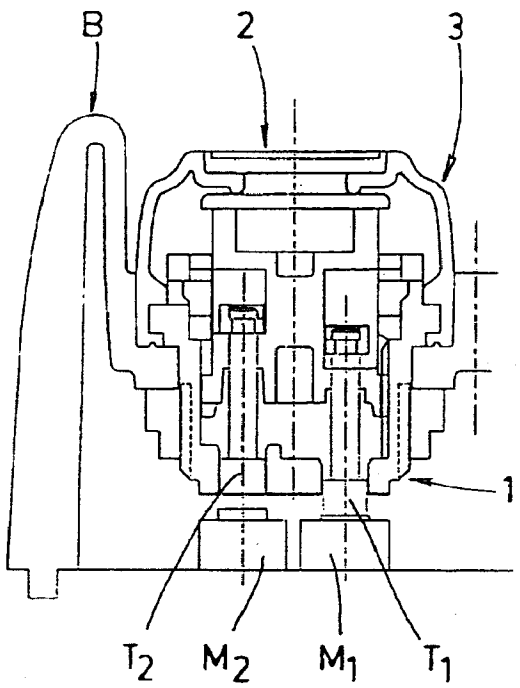

In accordance with the invention, and according to the execution illustrated, the operating means (5) are also basically useful to the operators as touch detector means for the specific positions or passes of the pushbutton during the different operative phases, where, successively:

a) In standby phase or position (FIGS. 1 and 5) the pushbutton (2), pushed by the pressure springs (4) is in an extreme position where the balls (53) of the device (5) are housed in the upper box (51*a*) and the formations (22) come up against the base of the busing (13) —thus limiting the expansive run—. In this position, the contact stops ($T_1$), ($T_2$) are kept away from the micrcswitches ($M_1$), ($M_2$).

b) In first operation phase or position (FIGS. 2 and 6), starting from the previous position, the pushbutton (2) pushed by an operator partially overcomes the resistance of the pressure springs (4). The balls (53) of the device (5) are housed in the lower box (51*b*). In this position, the contact stop ($T_1$) reaches the microswitch ($M_1$), whereas the contact stop ($T_2$) is maintained far from the microswitch ($M_2$).

c) In second operating phase or position (FIGS. 3 and 7) starting from the previous position, the pushbutton (2) pushed more by the operator totally overcomes the resistance of the pressure springs (4). The balls (53) surpass the bushing (13) and are housed in the cut defined between the edge of the bushing and the actual body-shell (1). In this position, the contact stop ($T_2$) also reaches the microswitch ($M_2$).

FIGS. 1–3 show successive detectable deformations of the cap through the successive positions of the pushbutton.

What is claimed is:

1. A double-pass pushbutton assembly for mounting in a button panel and able to act successively on one or both of two independent microswitches housed in the button panel, said pushbutton assembly comprising:

(a) a body shell for mounting in the button panel;

(b) a pushbutton mounted in the body shell for axial movement within the body shell between successive positions, the successive positions being a standby position, a first operation position, and a second operation position, the pushbutton having a portion that extends upwardly above the body shell, the portion of the pushbutton that extends above the body shell having a perimeter groove therein;

c) a leaktight and flexible sleeve which forms an hermetic seal between the body shell and the pushbutton without interfering with an axial movement of the pushbutton, one end of the sleeve mates with the perimeter groove in the pushbutton and an other end of the sleeve mates with the exterior of the body shell to form the seal, whereby the successive positions of the pushbutton are detectable;

(d) two contact stops mounted in the body shell for moving linearly therein, the contact stops mounted below the pushbutton, the contact stops having two different heights so that the contact stops make successive contact with the microswitches; and (e) operating means for holding the pushbutton in each of the successive positions in said body shell, the operating means housed in the pushbutton.

2. The pushbutton assembly of claim 1 wherein the body shell has a circumferential lip on an exterior of said body shell and the other end of the sleeve has a portion that mates with the lip to form the seal between the sleeve and the body.

3. The pushbutton assembly of claim 1 wherein:

diametrical grooves are formed in the body shell, the diametrical grooves facing the pushbutton;

the pushbutton has a diametrical box in which is housed the operating means, said diametrical box being open at each end and facing the diametrical grooves; and the operating means comprising an internal spring and balls at each end of the internal spring, the internal spring and balls mounted in the diametrical box, the internal spring pushing the balls outward to maintain the balls in one of the diametrical grooves.

4. The pushbutton assembly of claim 1 further comprising:

several pressure springs mounted in the shell body coaxially to one or both contact stops, the pressure springs urging the pushbutton to the standby position.

5. The pushbutton assembly of claim 1 wherein:

the pushbutton has a pushbutton lip which extends outward from the pushbutton against the shell body;

the shell body has a bushing mounted therein and diametrical grooves are formed in the bushing;

the bushing contacting the pushbutton lip when the pushbutton is in the standby position, thereby preventing involuntary disassembly of the pushbutton assembly.

6. A double-pass pushbutton assembly for mounting in a button panel and able to act successively on one or both of two independent microswitches housed in the button panel, said pushbutton assembly comprising:

(a) a body shell for mounting in the button panel, said body shell having a circumferential lip on an exterior of the body shell;

(b) a pushbutton mounted in the body shell for axial movement within the body shell between successive positions, the successive positions being a standby position, a first operation position, and a second operation position, the pushbutton having a portion that extends upwardly above the body shell, the portion of the pushbutton that extends above the body shell having a perimeter groove therein;

c) a leaktight and flexible sleeve which forms an hermetic seal between the body shell and the pushbutton without interfering with an axial movement of the pushbutton, one end of the sleeve forming the seal with the pushbutton in the perimeter groove and an other end of the sleeve forms the seal with the body shell over the circumferential lip, whereby the successive positions of the pushbutton are detectable;

(d) two contact stops mounted in the body shell for moving linearly therein, the contact stops mounted below the pushbutton, the contact stops having two different heights so that the contact stops make successive contact with the microswitches; and (e) operating means for holding the pushbutton in each of the successive positions in said body shell, the operating means housed in the pushbutton.

7. The pushbutton assembly of claim 6 wherein:

diametrical grooves are formed in the body shell, the diametrical grooves facing the pushbutton;

the pushbutton has a diametrical box in which is housed the operating means, said diametrical box being open at each end and facing the diametrical grooves;

the operating means comprising an internal spring and balls at each end of the internal spring, the internal spring and balls mounted in the diametrical box, the internal spring pushing the balls outward to maintain the balls in one of the diametrical grooves.

8. The pushbutton assembly of claim 7 further comprising:

several pressure springs mounted in the shell body coaxially to one or both contact stops, the pressure springs urging the pushbutton to the standby position.

9. The pushbutton assembly of claim 8 wherein:

the pushbutton has a pushbutton lip which extends outward from the pushbutton against the shell body;

the shell body has a bushing mounted therein and diametrical grooves are formed in the bushing;

the bushing contacting the pushbutton lip when the pushbutton is in the standby position, thereby preventing involuntary disassembly of the pushbutton assembly.

* * * * *